US012662813B2

(12) United States Patent
Ayukawa et al.

(10) Patent No.: US 12,662,813 B2
(45) Date of Patent: Jun. 23, 2026

(54) BUILDING

(71) Applicant: SEKISUI HOUSE, LTD., Osaka (JP)

(72) Inventors: Natsuki Ayukawa, Osaka (JP); Kentaro Kaneyasu, Osaka (JP); Toshiyuki Osada, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 194 days.

(21) Appl. No.: 18/289,180

(22) PCT Filed: May 27, 2021

(86) PCT No.: PCT/JP2021/020133
§ 371 (c)(1),
(2) Date: Nov. 1, 2023

(87) PCT Pub. No.: WO2022/249374
PCT Pub. Date: Dec. 1, 2022

(65) Prior Publication Data
US 2024/0218663 A1 Jul. 4, 2024

(51) Int. Cl.
*E04D 13/147* (2006.01)
*E04B 7/06* (2006.01)
*E04D 13/143* (2006.01)

(52) U.S. Cl.
CPC ..... *E04B 7/063* (2013.01); *E04D 13/143* (2013.01); *E04D 13/1478* (2013.01)

(58) Field of Classification Search
CPC ..... E04D 13/1475; E04D 13/006; E04D 13/0335; E04D 13/0404; E04D 13/0431;
(Continued)

(56) References Cited

U.S. PATENT DOCUMENTS 213,035 A * 3/1879 Boyd ..... E04B 7/063 52/460
618,074 A * 1/1899 Dyer ..... E04D 13/1415 52/13

(Continued)

FOREIGN PATENT DOCUMENTS

CA 670029 A 9/1963
GB 2464692 A 4/2010

(Continued)

OTHER PUBLICATIONS

International Search Report, issued in PCT/JP2021/020133, PCT/ISA/210, dated Aug. 3, 2021.

(Continued)

*Primary Examiner* — Kyle J. Walraed-Sullivan
(74) *Attorney, Agent, or Firm* — Birch, Stewart, Kolasch & Birch, LLP

(57) ABSTRACT

A building includes a hipped roof, an erected part, and a water guide body. The hipped roof includes a first roof part, a second roof part, and a hip that is provided at a boundary part between the first roof part and the second roof part, and that protrudes upward from a roof upper surface of the first roof part. The erected part is erected on the first roof part while extending from a part of the hip, the part being below a ridge beam, toward a side opposite to the second roof part, and includes a side surface facing the ridge beam. The water guide body is provided over the first roof part and the side surface of the erected part to guide water flowing along the first roof part to a lateral side of the erected part. Then, the water guide body is connected to the hip, and has a shape for restricting accumulation of water in a region between the hip, the first roof part, and the erected part.

5 Claims, 17 Drawing Sheets

(58) Field of Classification Search
CPC ..... E04D 13/0445; E04D 13/0481; E04D 13/147; E04D 13/1473; E04D 13/1476; E04D 13/1478; E04D 13/174; E04D 2013/0422; E04D 2013/045; E04D 2013/0454; E04D 2013/0463; E04D 2013/0486; E04D 2001/305; E04D 1/3402; E04B 7/02; E04B 7/022; E04B 7/063
See application file for complete search history.

(56) References Cited

U.S. PATENT DOCUMENTS

| | | | | | |
|---|---|---|---|---|---|
| 1,331,833 | A * | 2/1920 | White | G10F 1/02 | 84/34 |
| 1,331,835 | A * | 2/1920 | White | E04D 13/1475 | 285/43 |
| 2,231,065 | A | 2/1941 | Gabel | | |
| 3,698,142 | A * | 10/1972 | Theriault | E04D 13/1475 | 52/556 |
| 3,949,657 | A * | 4/1976 | Sells | F24F 7/02 | 454/365 |
| 4,803,813 | A * | 2/1989 | Fiterman | E04D 13/174 | 156/227 |
| 5,056,277 | A * | 10/1991 | Wilson | E04D 13/1475 | 52/60 |
| 5,077,943 | A | 1/1992 | McGady | | |
| 5,109,641 | A * | 5/1992 | Halan | E04D 13/1478 | 52/62 |
| 5,271,201 | A * | 12/1993 | Noone | E04D 1/20 | 52/518 |
| 5,704,834 | A * | 1/1998 | Sells | F24F 7/02 | 52/149 |
| 6,681,530 | B1 * | 1/2004 | Givens | E04D 13/1478 | 52/62 |
| 9,528,267 | B1 * | 12/2016 | Penrod | E04D 3/38 | |
| 2002/0086634 | A1 * | 7/2002 | Sells | F24F 7/02 | 454/365 |
| 2003/0046878 | A1 * | 3/2003 | Zdeb | E04D 13/1478 | 52/272 |
| 2003/0208964 | A1 * | 11/2003 | Batt, Sr. | E04D 13/1475 | 52/11 |
| 2005/0183345 | A1 * | 8/2005 | Allen | E04D 13/1478 | 52/58 |
| 2005/0204647 | A1 * | 9/2005 | Zdeb | E04D 1/36 | 52/58 |
| 2018/0087274 | A1 * | 3/2018 | Grubka | E04D 1/30 | |
| 2023/0287685 | A1 * | 9/2023 | Osada | E04D 13/0445 | |
| 2025/0075507 | A1 * | 3/2025 | Yachi | E04D 13/158 | |

FOREIGN PATENT DOCUMENTS

| | | | | | |
|---|---|---|---|---|---|
| GB | 2508650 | A * | 6/2014 | E04B 1/78 | |
| JP | 64-7628 | U | 1/1989 | | |
| JP | 2014-5644 | A | 1/2014 | | |
| WO | WO-2022029991 | A1 * | 2/2022 | E04D 13/14 | |

OTHER PUBLICATIONS

Aerial top view of building steep brown shingle roof, brick chimneys and small attic windows on house top with metal tile roof. Roofing, repair and re Stock Photo—Alamy [online], retrieved from Internet on Oct. 30, 2024, URLs: <https://www.alamy.com/aerial-top-view-of-building-steep-brown-shingle-roof-brick-chimneys-and small-attic-windows-on-house-top-with-metal-tile-roof-roofing-repair-and-re-image240958902.html?imageid=2EB75715-6498-4C33-961F-BFCE33F600C1&p=294898&pn=2&searchId=83d383b91f0e38c2a988b1f10c2c34d2&searchtype=9> <https://www.alamy.com/aerial-top-view-of-building-steep-brown-shingle-roof-brick-chimneys-and-small-attic-windows-on-house-top-with-metal-tile-roof-roofing-repair-and-re-image246858018.html?imageid=1581972D-E41C-48BE-AB28-5940469F5931&p=294898&pn-2&searchid=83d383b91f0e38c2a988b1f10c2c34d2&searchtype=9> and <https://www.alamy.com/aerial-top-view-of-building-steep-brown-shingle-roof-brick-chimneys-and-small-attic-windows-on-house-top-with-metal-tile-roof-roofing-repair-and-re-image260679018.html?imageid=D754F9FB-B7FB-4091-9C36-D36E99B58E73&p=294898&pn=2&searchId=83d383b91f0e38c2a988b1f10c2c34d2&searchtype=9>.

Aerial top view of new residential house cottage with shingle roof on fenced big yard on sunny day Stock Photo—Alamy [online], retrieved from Internet on Oct. 30, 2024, URL: <https://www.alamy.com/aerial-top-view-of-new-residential-house-cottage-with-shingle-roof-on-fenced-big-yard-on-sunny-day-image239826818.html?imageid=1E9AF8AC-3C61-43B9-BE91-CC92D4179372&p=294898&pn=2&searchId=83d383b91f0e38c2a988b1f10c2c34d2&searchtype=9>.

Aerial view of house roof structure covered with brown metal tile sheets Stock Photo—Alamy, URL: <https://www.alamy.com/aerial-view-of-house-roof-structure-covered-with-brown-metal-tile-sheets-image367419515.html?imageid=BF822D88-84B7-48B4-A518-17EA6BCF8300&p=294898&pn=1&searchId=2a433af500bf5616b4814f2829cd371c&searchtype=9> and Detail of a house roof surface covered with brown metal tile sheets Stock Photo—Alamy, URL: <https://www.alamy.com/detail-of-a-house-roof-surface-covered-with-brown-metal-tile-sheets-image385098739.html?imageid=B05E7ECD-9DCE-46B6-B662-D07B94D8EEFE&p=294898&pn=3&searchId=650482fd203562e7dda8c5e76790ad58&searchtype=9>, retrieved from Internet on Oct. 30, 2024.

Australian Office Action for corresponding Australian Application No. 2021447669, dated Nov. 1, 2024.

First Slate Tile Copper Roof by Chicagoland Roofer | Ryan Restorations [online], retrieved from Internet on Oct. 30, 2024, URL: <https://tileandslateroof.com/about/first-slate-copper-tile-roof/> and 1st Slate Tile Copper Roof by Ryan Restorations, Roofer in Chicagoland, YouTube, viewed on Internet on Oct. 30, 2024, URL: < https://www.youtube.com/watch?v=cOM_7N77Xtg>.

French Country Estate | Douglas Vanderhorn Architects [online], retrieved from Wayback Machine on Oct. 30, 2024 [published on Feb. 12, 2018, URL: <https://web.archive.org/web/20180212012006/http://vanderhornarchitects.com/residences/french-country-estate>.

Q & A: 'What thickness of lead do I need for my project?' Midland Lead [online], retrieved from Internet on Oct. 30, 2024, URL: <https://www.midlandlead.co.uk/q-a-what-thickness-of-lead-do-i-need-for-my-project/>.

* cited by examiner

BUILDING

TECHNICAL FIELD

The present invention relates to a building.

BACKGROUND ART

For example, a building including a hipped roof having a plurality of roof parts and an erected part such as an outer wall erected on the roof parts has been conventionally known as disclosed in Patent Literature 1. This type of a building requires a structure to be installed in a boundary part between the roof parts and the erected part to prevent entry of water such as rainwater from the boundary part toward the erected part.

Patent Literature 1 discloses a technique in which a boundary part between the roof parts and the erected part is positioned at the top of the roof parts, and a structure including a flashing cover and the like is installed at the boundary part. The boundary part between the roof parts and the erected part is positioned at the top of the roof parts in this case, so that water around the boundary part flows down along the roof parts via the flashing cover.

Meanwhile, a hipped roof includes a ridge beam constituting the top of the hipped roof, and a protrusion such as a hip provided extending downward from the ridge beam and protruding upward from an upper surface of roof parts. Then, a boundary part between the roof parts and an erected part may be positioned below the ridge beam and intersect the protrusion. This structure allows water on the roof parts to flow along the roof parts toward the boundary part between the roof parts and the erected part. The water having reached the boundary part between the roof parts and the erected part may accumulate in a region between the roof parts, the erected part, and the protrusion.

CITATION LIST

Patent Literature

Patent Literature 1: JP S64-7628 U

SUMMARY OF INVENTION

The present invention has been made in light of the above-mentioned circumstances, and an object of the present invention is to provide a building capable of suppressing accumulation of water flowing along a roof part in a region between the roof part, an erected part, and a protrusion.

A building according to an aspect of the present invention includes: a hipped roof having a first roof part and a second roof part adjacent to each other in a horizontal direction, and a protrusion provided at a boundary part between the first roof part and the second roof part, the protrusion protruding upward from an upper surface of the first roof part; an erected part erected on the first roof part, the erected part having a side surface extending from a part of the protrusion toward a side opposite to the second roof part, the part being below an uppermost part of the first roof part, and the side surface facing the uppermost part of the first roof part; and a water guide body provided over the first roof part and the side surface of the erected part to guide water flowing along the first roof part toward a lateral side of the erected part. The water guide body is connected to the protrusion and has a shape for restricting accumulation of water in a region between the protrusion, the first roof part, and the erected part.

Detailed description and accompanying drawings below more clarify objects, features, and advantages of the present invention.

DESCRIPTION OF EMBODIMENTS

Figure 1:
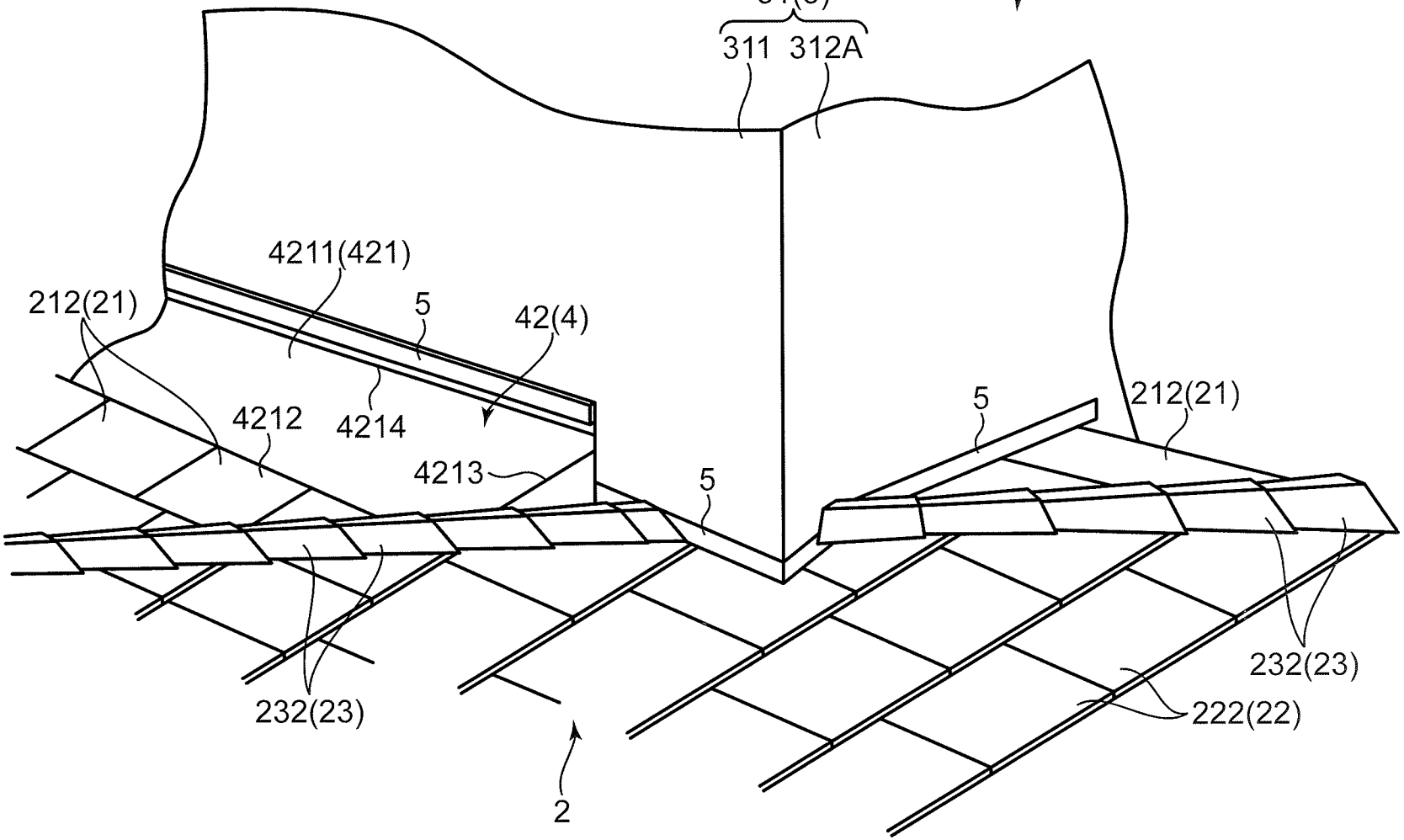
FIG. 1 is a perspective view illustrating a configuration of a building according to an embodiment of the present invention.

Hereinafter, a building according to an embodiment of the present invention will be described with reference to the drawings.

Configuration of Building

As illustrated in FIGS. 1 to 6, a building 1 according to the present embodiment has a structure in which a building body including a hipped roof 2 and a building body including an outer wall part 3 connected to the hipped roof 2 are connected to each other in a horizontal direction. The building 1 further includes a water guide body 4 that guides water such as rainwater flowing along the hipped roof 2 toward a lateral side of an outer wall part 3.

<Hipped Roof>

The hipped roof 2 includes a first roof part 21 and a second roof part 22 that are adjacent to each other in the horizontal direction, a hip 23, and a ridge beam 24. The ridge beam 24 extends horizontally at the top of the hipped roof 2. The ridge beam 24 constitutes an uppermost part of the first roof part 21.

Figure 5:
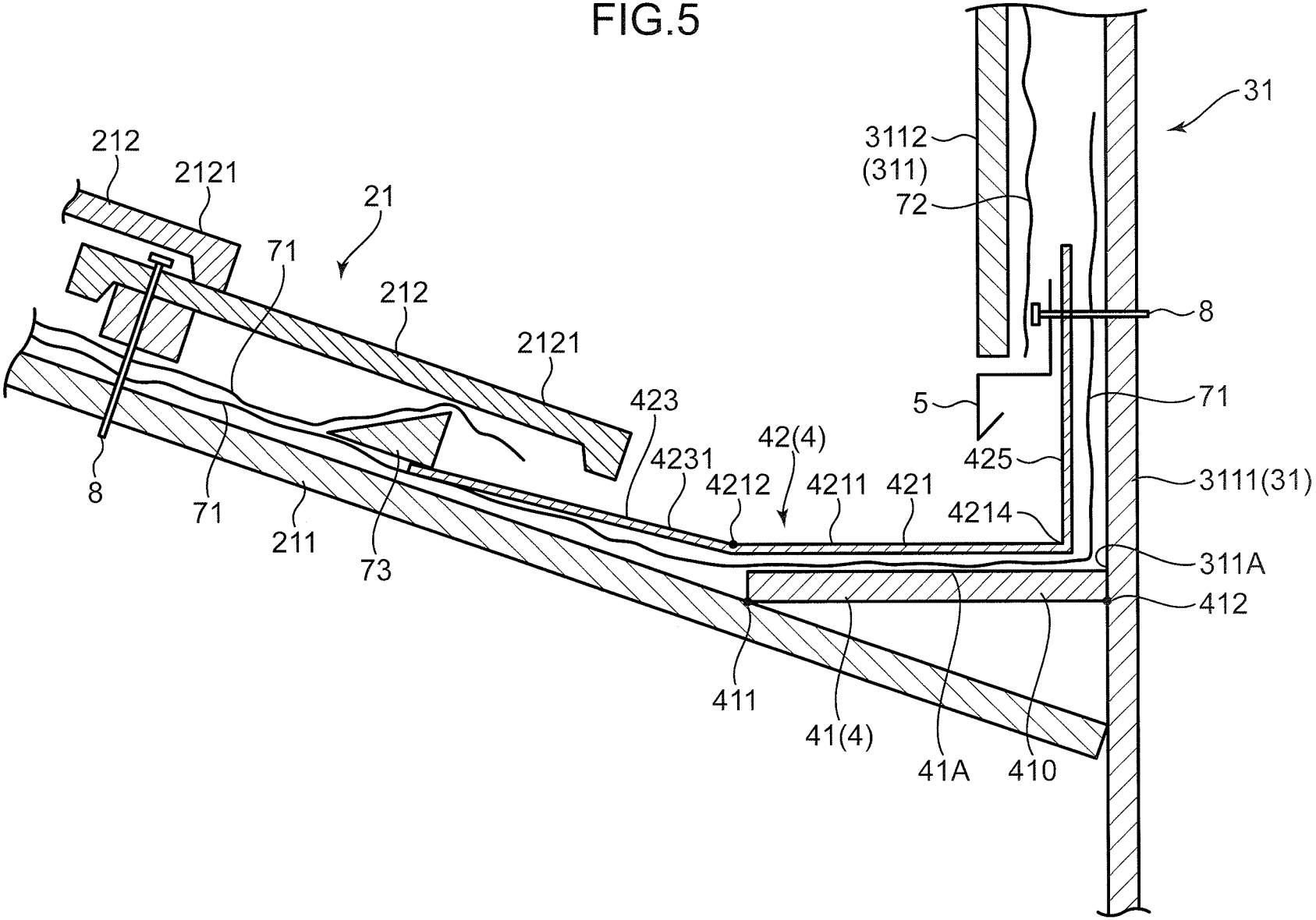
FIG. 5 is a sectional view taken along line V-V of FIG. 2.

The first roof part 21 and the second roof part 22 incline downward with respect to the ridge beam 24. The first roof part 21 includes a first roof board 211 inclining downward with respect to the ridge beam 24, a roofing material 71 for covering an upper surface of the first roof board 211 to waterproof the first roof board 211, and a first base tile 212 provided and hooked on a first batten seam 213 above the roofing material 71. As illustrated in FIG. 5, the first base tile 212 is fixed to the first roof board 211 by a fixing member 8 such as a nail. The first base tile 212 is disposed at a lowermost part above the first roof board 211 and supported from below by a base tile support material 73. Similarly, the second roof part 22 includes a second roof board 221 inclining downward with respect to the ridge beam 24, the roofing material 71 for covering an upper surface of the second roof board 221 to waterproof the second roof board 221, and a second base tile 222 provided and hooked on a second batten seam 223 above the roofing material 71.

Figure 3:
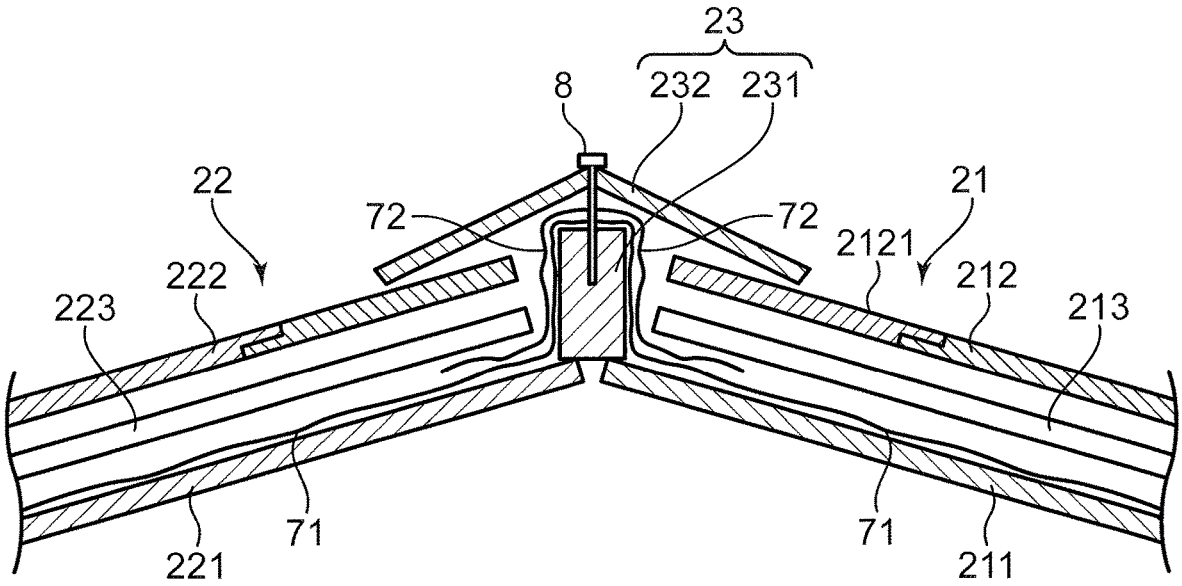
FIG. 3 is a sectional view taken along line III-III of FIG. 2.

The hip 23 is provided at a boundary part between the first roof part 21 and the second roof part 22 while extending downward from the ridge beam 24. As illustrated in FIG. 3, the hip 23 is an example of a protrusion protruding upward from a roof upper surface 2121 of the first roof part 21, the roof upper surface 2121 being constituted of an upper surface of the first base tile 212. The protrusion is not limited to the hip 23 as long as the protrusion protrudes upward from roof upper surface 2121 of the first roof part 21.

The hip 23 includes a hip base 231 installed at a boundary part between the first roof board 211 and the second roof board 221, a waterproof material 72 covering the hip base 231, and a hip tile 232 fixed above the hip base 231 with the waterproof material 72 interposed therebetween by the fixing member 8 such as a nail. Between the hip base 231 and the waterproof material 72, the roofing material 71 covering the first roof board 211 and the second roof board 221 is inserted. The hip base 231 is an example of a protrusion body provided at a boundary part between the first roof part 21 and the second roof part 22. Then, the hip tile 232 is an example of a covering member attached to an upper surface of the protrusion body while covering the protrusion body and the first roof part 21 from above.

<Outer Wall Part>

The outer wall part 3 includes an erected part 31 erected on the first roof part 21. The erected part 31 serves as a wall connected to the first roof part 21, and includes a first wall 311 expanding in the horizontal direction and a vertical direction and facing the ridge beam 24, and a pair of second walls 312A and 312B respectively extending in a direction away from the ridge beam 24 from one end and another end of the first wall 311 in the horizontal direction.

Figure 2:
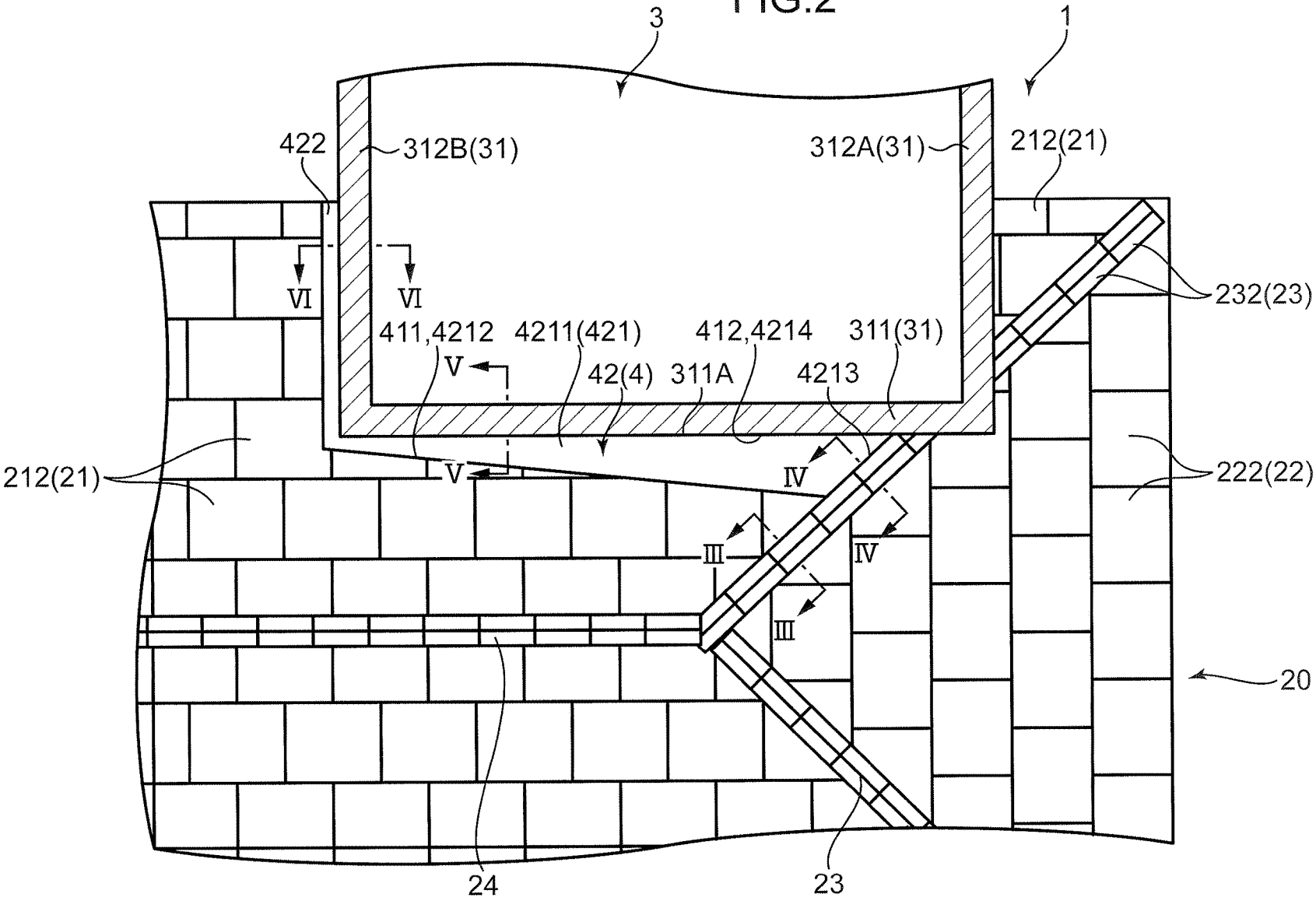
FIG. 2 is a diagram of a building as viewed from above.

The first wall 311 is connected to the first roof part 21 and the second roof part 22 while having one end in the horizontal direction positioned closer to the second roof part 22 than the hip 23, and the other end in the horizontal direction positioned on the first roof part 21. As illustrated in FIGS. 2 and 5, the first wall 311 includes a side surface 311A extending from a part below the ridge beam 24 in the hip 23 toward the first roof part 21 opposite to the second roof part 22 and facing the ridge beam 24. That is, the side surface 311A of the first wall 311 is a wall surface extending in the horizontal direction and the vertical direction while facing the ridge beam 24. The side surface 311A of the first wall 311 extends in the horizontal direction while having one end in the horizontal direction connected to a part below the ridge beam 24 in the hip 23, and another end in the horizontal direction separated from the hip 23. The side surface 311A of the first wall 311 in the present embodiment extends parallel to the ridge beam 24 in the horizontal direction.

The first wall 311 includes a first wall plate material 3111 connected to the first roof board 211 of the first roof part 21 and defining the side surface 311A, a first siding material 3112 attached covering the first wall plate material 3111, and the waterproof material 72 disposed between the first wall plate material 3111 and the first siding material 3112. Between the first wall plate material 3111 and the first siding material 3112, the roofing material 71 covering the first roof board 211 is inserted. The first wall 311 also includes a wall draining material 5 for restricting entry of water into a region below a lower end of the first siding material 3112 in the first wall plate material 3111. The wall draining material 5 is fixed to the first wall plate material 3111 by the fixing member 8 such as a nail.

The pair of second walls 312A and 312B includes the second wall 312A extending from one end of the first wall 311 in the horizontal direction in a direction away from the ridge beam 24. Then, the second wall 312B extends from the other end of the first wall 311 in the horizontal direction in a direction away from the ridge beam 24.

Figure 6:
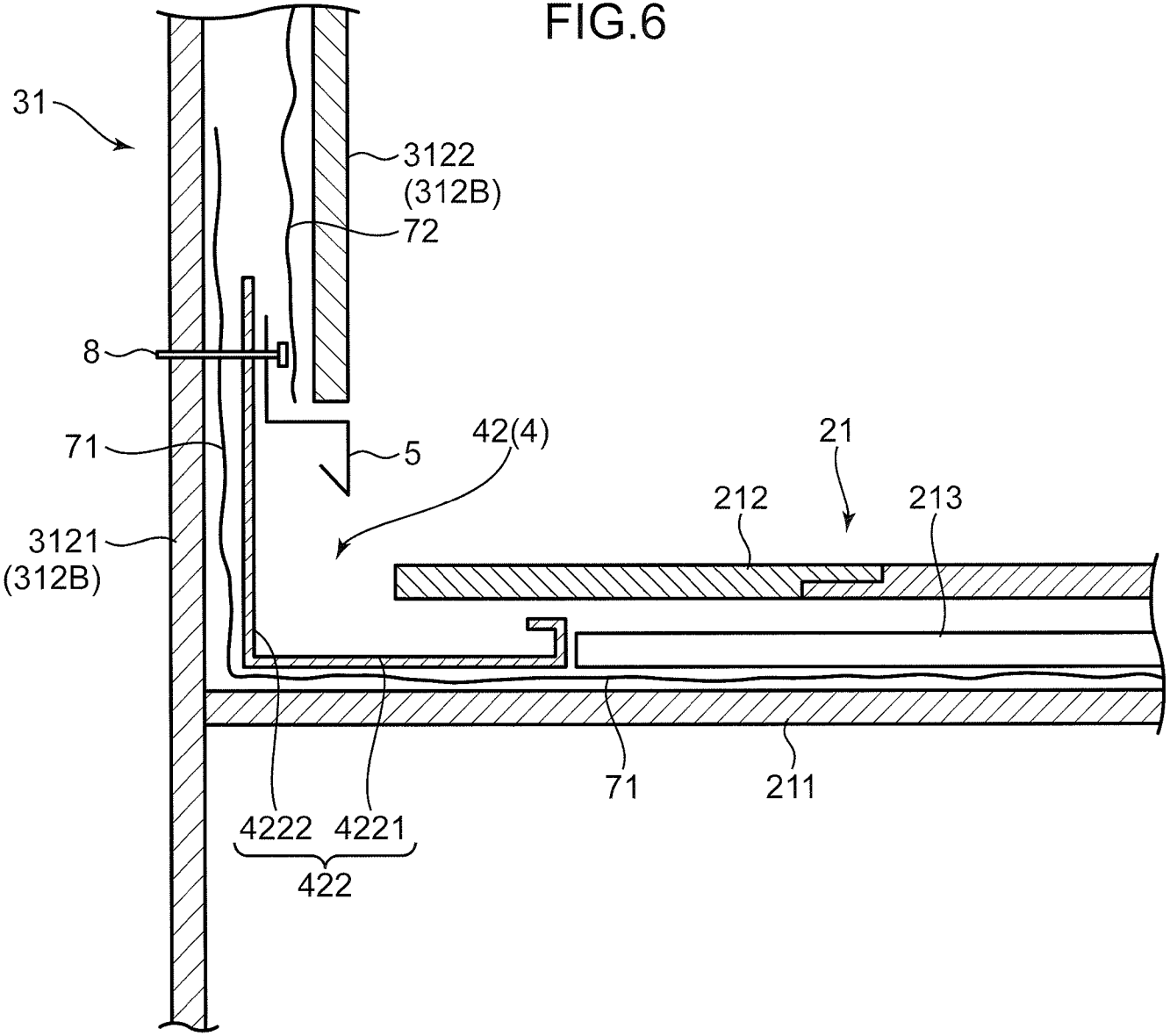
FIG. 6 is a sectional view taken along line VI-VI of FIG. 2.

As illustrated in FIG. 6, the pair of second walls 312A and 312B each includes a second wall plate material 3121 connected to the first roof board 211 of the first roof part 21, a second siding material 3122 attached covering the second wall plate material 3121, and the waterproof material 72 disposed between the second wall plate material 3121 and the second siding material 3122. Between the second wall plate material 3121 and the second siding material 3122, the roofing material 71 covering the first roof board 211 is inserted. The pair of second walls 312A and 312B each includes the wall draining material 5 for restricting entry of water into a region below a lower end of the second siding material 3122 in the second wall plate material 3121. The wall draining material 5 is fixed to the second wall plate material 3121 by the fixing member 8 such as a nail.

<Water Guide Body>

The water guide body 4 will be described with reference to FIGS. 7 and 8 in addition to FIGS. 1 to 6. Water on the first roof part 21 inclining downward with respect to the ridge beam 24 flows along the roof upper surface 2121 toward the first wall 311 of the erected part 31 erected on the first roof part 21. The water guide body 4 is provided over the first roof part 21 and the side surface 311A of the first wall 311 to guide the water flowing along the roof upper surface 2121 of the first roof part 21 to a lateral side of the first wall 311.

The water guide body 4 is also connected to the hip 23 protruding upward from the roof upper surface 2121 of the first roof part 21, and has a shape for restricting accumulation of water in a region between the hip 23, the first roof part 21, and the side surface 311A of the first wall 311. The shape of the water guide body 4 as described above enables suppressing accumulation of water flowing along the first roof part 21 in a region between the hip 23, the first roof part 21, and the side surface 311A of the first wall 311.

Figure 4:
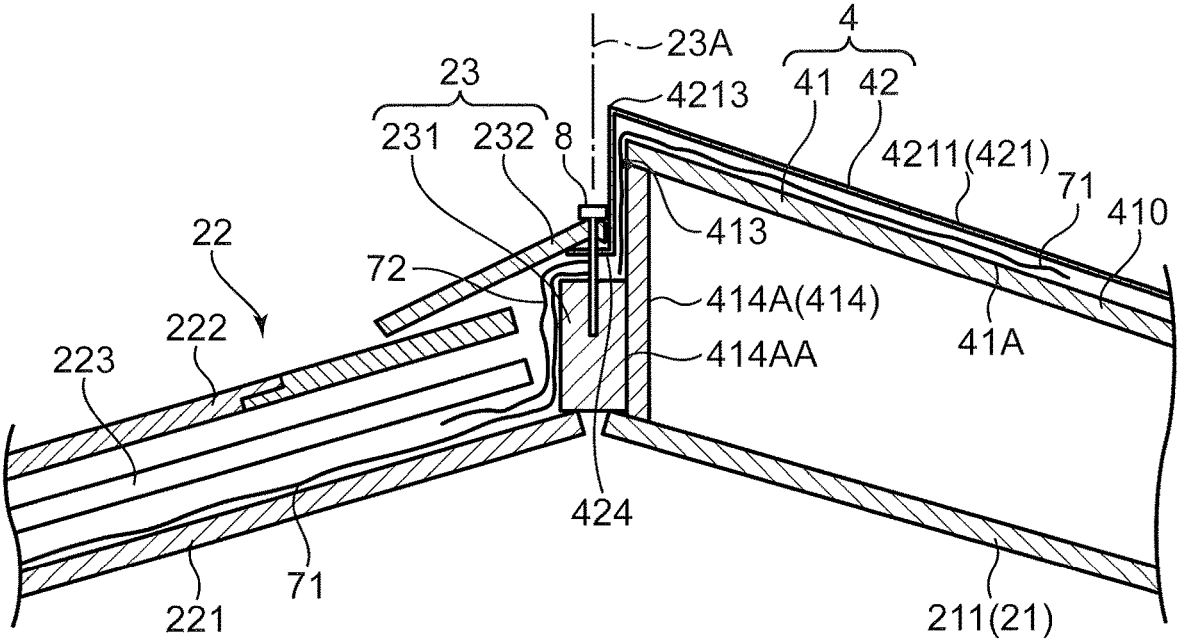
FIG. 4 is a sectional view taken along line IV-IV of FIG. 2.

The water guide body 4 includes a water guide base 41 and a water guide plate 42. The water guide base 41 constitutes a base of the water guide body 4, and is provided over the first roof part 21 and the side surface 311A of the first wall 311 to cover a boundary part between the first roof part 21 and the first wall 311 from above. The water guide base 41 is connected to the first roof part 21, the first wall 311, and the hip 23. Specifically, the water guide base 41 includes a covering plate 410 provided over the first roof part 21 and the side surface 311A of the first wall 311 to cover the upper surface of the first roof board 211 in the first roof part 21, and a plurality of support plates 414 supporting the covering plate 410 from below, as illustrated in FIGS. 4 and 5. The covering plate 410 has a lower surface opposite to an upper surface 41A facing upward, the lower surface including a roof connection edge 411 connected to the first roof board 211 of the first roof part 21, a wall connection edge 412 connected to the first wall plate material 3111 (side surface 311A) of the first wall 311, and a hip side end edge 413 including a region connected to the hip base 231 of the hip 23.

As illustrated in FIG. 5, the covering plate 410 in the present embodiment includes the roof connection edge 411 and the wall connection edge 412 that are positioned at an equal height in a sectional view taken along a plane orthogonal to the side surface 311A of the first wall 311 and the horizontal direction. That is, the upper surface 41A of the covering plate 410 is orthogonal to the side surface 311A of the first wall 311. The upper surface 41A of the covering plate 410 inclines downward with distance from the hip 23. As illustrated in FIG. 2, the roof connection edge 411 extends from the hip 23 to the other end of the side surface 311A in the horizontal direction of the first wall 311 in a plan view in which the water guide base 41 is viewed from vertically above. The roof connection edge 411 also inclines downward with distance from the hip 23 in a front view in which the water guide base 41 is viewed from a direction orthogonal to the side surface 311A of the first wall 311. The wall connection edge 412 extends along the side surface 311A from the hip 23 to the other end of the side surface 311A in the horizontal direction of the first wall 311.

As illustrated in FIG. 4, the covering plate 410 includes the hip side end edge 413 that is positioned at a position closer to the first roof part 21 than a ridge axis 23A of the hip 23 along the boundary part between the first roof part 21 and the second roof part 22.

The plurality of support plates 414 supports the covering plate 410 from below while being disposed at predetermined intervals in the horizontal direction parallel to the side surface 311A of the first wall 311. As illustrated in FIG. 4, the plurality of support plates 414 includes a specific support plate 414A positioned closest to the hip 23, the specific support plate 414A being connected to a side surface of the hip base 231, the side surface facing the first roof part 21. The specific support plate 414A includes a surface 414AA connected to the hip base 231, the surface 414AA extending from the hip side end edge 413 of the covering plate 410 to the upper surface of the first roof board 211. Thus, the specific support plate 414A is positioned at a position closer to the first roof part 21 than the ridge axis 23A of the hip 23 along the boundary part between the first roof part 21 and the second roof part 22.

The water guide plate 42 is a plate-like member provided over the first roof part 21 and the side surface 311A of the first wall 311 while being disposed on the upper surface 41A of the covering plate 410 in the water guide base 41. Between the water guide base 41 and the water guide plate 42, the roofing material 71 covering the first roof board 211 is inserted.

As illustrated in FIGS. 2 and 4 to 7, the water guide plate 42 includes a water receiver 421, an eaves guide part 422, a roof covering part 423, a hip covering part 424, and a wall covering part 425.

The water receiver 421 is a part of the water guide plate 42, the part being placed on the upper surface 41A of the covering plate 410. The water receiver 421 includes a water receiving surface 4211 facing upward to receive water flowing along the first roof part 21. The water receiver 421 is placed on the upper surface 41A of the covering plate 410 to cover the upper surface 41A. The water receiver 421 includes a water receiving roof side end edge 4212 positioned on the roof connection edge 411 of the covering plate 410, a water receiving wall side end edge 4214 positioned on the wall connection edge 412 of the covering plate 410, and a water receiving hip side end edge 4213 positioned on the hip side end edge 413 of the covering plate 410.

As illustrated in FIG. 5, the water receiver 421 in the present embodiment includes the water receiving surface 4211 for receiving water flowing along the first roof part 21, the water receiving surface 4211 being parallel to the upper surface 41A of the covering plate 410. Then, the water receiving roof side end edge 4212 and the water receiving wall side end edge 4214 are positioned at an equal height in a sectional view taken along a plane orthogonal to the side surface 311A of the first wall 311 and the horizontal direction. That is, the water receiving surface 4211 of the water receiver 421 is orthogonal to the side surface 311A of the first wall 311 as with the upper surface 41A of the covering plate 410. The water receiving surface 4211 of the water receiver 421 inclines downward with distance from the hip 23. This structure enables water received by the water receiving surface 4211 to flow away from the hip 23. Thus, accumulation of water in a region between the hip 23, the first roof part 21, and the side surface 311A of the first wall 311 can be more reliably suppressed.

As illustrated in FIG. 2, the water receiving roof side end edge 4212 extends from the hip 23 to the other end of the side surface 311A in the horizontal direction of the first wall 311 in a plan view in which the water receiver 421 is viewed from vertically above, as with the roof connection edge 411 of the covering plate 410. The water receiving roof side end edge 4212 also inclines downward with distance from the hip 23 in a front view in which the water receiver 421 is viewed from a direction orthogonal to the side surface 311A of the first wall 311, as with the roof connection edge 411 of the covering plate 410. This structure enables water having flowed along the first roof part 21 and having reached the water receiving roof side end edge 4212 of the water receiver 421 to flow away from the hip 23 along the water receiving roof side end edge 4212. Thus, accumulation of water in a region between the hip 23, the first roof part 21, and the side surface 311A of the first wall 311 can be more reliably suppressed.

As with the wall connection edge 412 of the covering plate 410, the water receiving wall side end edge 4214 extends along the side surface 311A from the hip 23 to the other end of the side surface 311A in the horizontal direction of the first wall 311.

Figure 8:
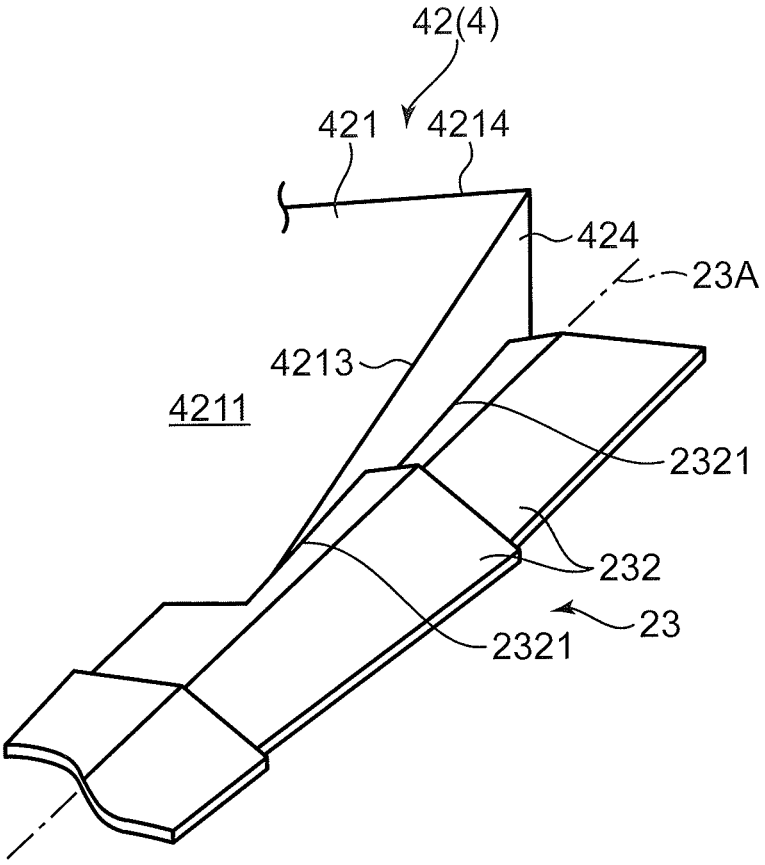
FIG. 8 is a perspective view illustrating a positional relationship between a hip of a hipped roof and a water guide body in a building.

As illustrated in FIGS. 4 and 8, the water receiver 421 includes the water receiving hip side end edge 4213 that is positioned at a position closer to the first roof part 21 than the ridge axis 23A of the hip 23, as with the hip side end edge 413 of the covering plate 410. The hip 23 includes the hip tile 232 with a cutout 2321 (FIG. 8) provided at a position closer to the first roof part 21 than an attachment position (ridge axis 23A) to the hip base 231, the cutout 2321 allowing a space for receiving the water receiving hip side end edge 4213 of the water receiver 421 to be formed. This structure enables the water guide body 4 to be disposed adjacent to the hip 23 while the first roof part 21 is covered with the hip tile 232 in a region other than a region where the water guide body 4 is provided. The cutout 2321 of the hip tile 232 has a shape acquired by cutting out the hip tile 232 other than a core part positioned on the ridge axis 23A. The water receiving hip side end edge 4213 of the water receiver 421, the hip side end edge 413 of the covering plate 410, and the specific support plate 414A are each positioned at a position closer to the first roof part 21 than the ridge axis 23A of the hip 23, so that using the hip tile 232 with the cutout 2321 allows the water guide base 41 and the water receiver 421 to be received by the cutout 2321. This structure enables preventing the hip tile 232 from being divided by the water guide body 4, so that the hip tile 232 can be provided over the entire boundary part between the first roof part 21 and the second roof part 22.

As illustrated in FIG. 2, the eaves guide part 422 is a part of the water guide plate 42, the part extending from a section corresponding to the other end of the side surface 311A in the horizontal direction of the first wall 311 in the water receiver 421 to eaves of the first roof part 21 along the second wall 312B. As illustrated in FIG. 6, the caves guide part 422 includes a water receiving coupling section 4221 coupled to the water receiver 421 and a wall covering coupling section 4222 connected to the wall covering part 425 described later. The caves guide part 422 guides water flowing away from the hip 23 on the water receiving surface 4211 of the water receiver 421 to the eaves of the first roof part 21. This structure enables the water flowing along the first roof part 21 to be guided to the eaves of the first roof part 21 via the water receiver 421 and the caves guide part 422.

Figure 7:
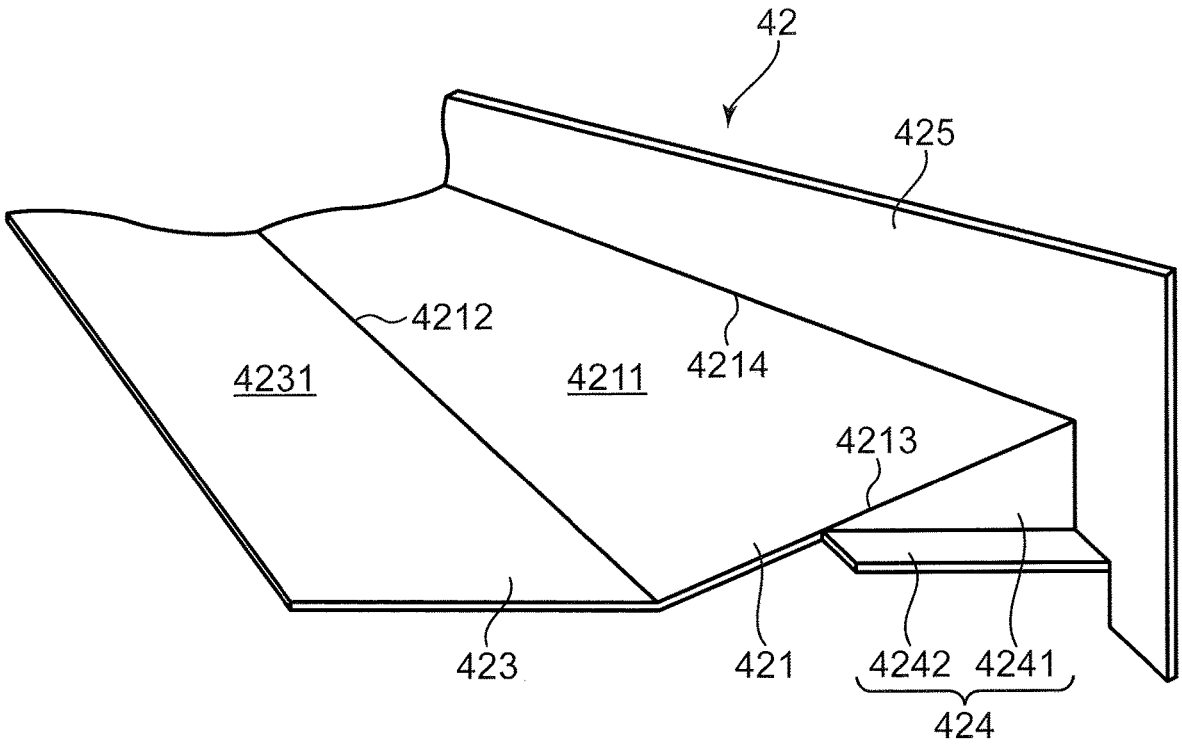
FIG. 7 is a perspective view illustrating a configuration of a water guide plate constituting a water guide body provided in a building.

As illustrated in FIGS. 5 and 7, the roof covering part 423 is a part of the water guide plate 42, the part extending from the water receiving roof side end edge 4212 of the water receiver 421 toward the ridge beam 24 while covering the first roof board 211 of the first roof part 21 from above. The roof covering part 423 includes a leading end opposite to the water receiving roof side end edge 4212, the leading end being disposed under the base tile support material 73 above the first roof board 211 to allow a covering upper surface 4231 constituting an upper surface of the roof covering part 423 to be positioned below the roof upper surface 2121 of the first roof part 21. The covering upper surface 4231 of the roof covering part 423 is connected to the water receiving surface 4211 of the water receiver 421 with the water receiving roof side end edge 4212 interposed therebetween. The roof covering part 423 delivers water having flowed along the roof upper surface 2121 of the first roof part 21 and having reached the covering upper surface 4231 to the water receiving surface 4211 through the water receiving roof side end edge 4212.

As illustrated in FIGS. 4 and 7, the hip covering part 424 is a part in the water guide plate 42, the part being configured to cover the hip base 231. The hip covering part 424 includes a suspended section 4241 extending downward from a region above the hip base 231 at the water receiving hip side end edge 4213 of the water receiver 421 and covering the specific support plate 414A from a lateral side, and a covering section 4242 extending in the horizontal direction from a lower end of the suspended section 4241. The covering section 4242 of the hip covering part 424 is an example of a covering part provided in the water guide plate 42 to cover the hip base 231 (protrusion body) from above and vertically overlap the hip tile 232 (covering member). The hip tile 232 is attached to the hip base 231 while vertically overlapping the covering section 4242 of the hip covering part 424, the covering section 4242 covering the hip base 231 from above. This structure causes the hip tile 232 and the covering section 4242 to vertically overlap each other while the covering section 4242 is positioned below the hip tile 232 above the hip base 231. The hip tile 232 and the covering section 4242 vertically overlap each other, so that entry of water at a connection part between the hip 23 and the water guide body 4 can be prevented.

As illustrated in FIGS. 5 and 7, the wall covering part 425 is a part of the water guide plate 42, the part extending upward from the water receiving wall side end edge 4214 of the water receiver 421 along the side surface 311A while covering the side surface 311A of the first wall 311. The wall covering part 425 prevents water on the water receiving surface 4211 of the water receiver 421 from reaching the side surface 311A of the first wall 311.

As described above, the building 1 according to the present embodiment includes the water guide body 4 provided over the first roof part 21 and the side surface 311A of the first wall 311, and the water guide body 4 can prevent water flowing along the roof upper surface 2121 of the first roof part 21 from accumulating in a region between the hip 23, the first roof part 21, and the first wall 311.

Construction Procedure of Building

Next, a construction procedure of the building 1 will be described with reference to FIGS. 9 to 16 in addition to FIGS. 1 and 2.

Figure 9:
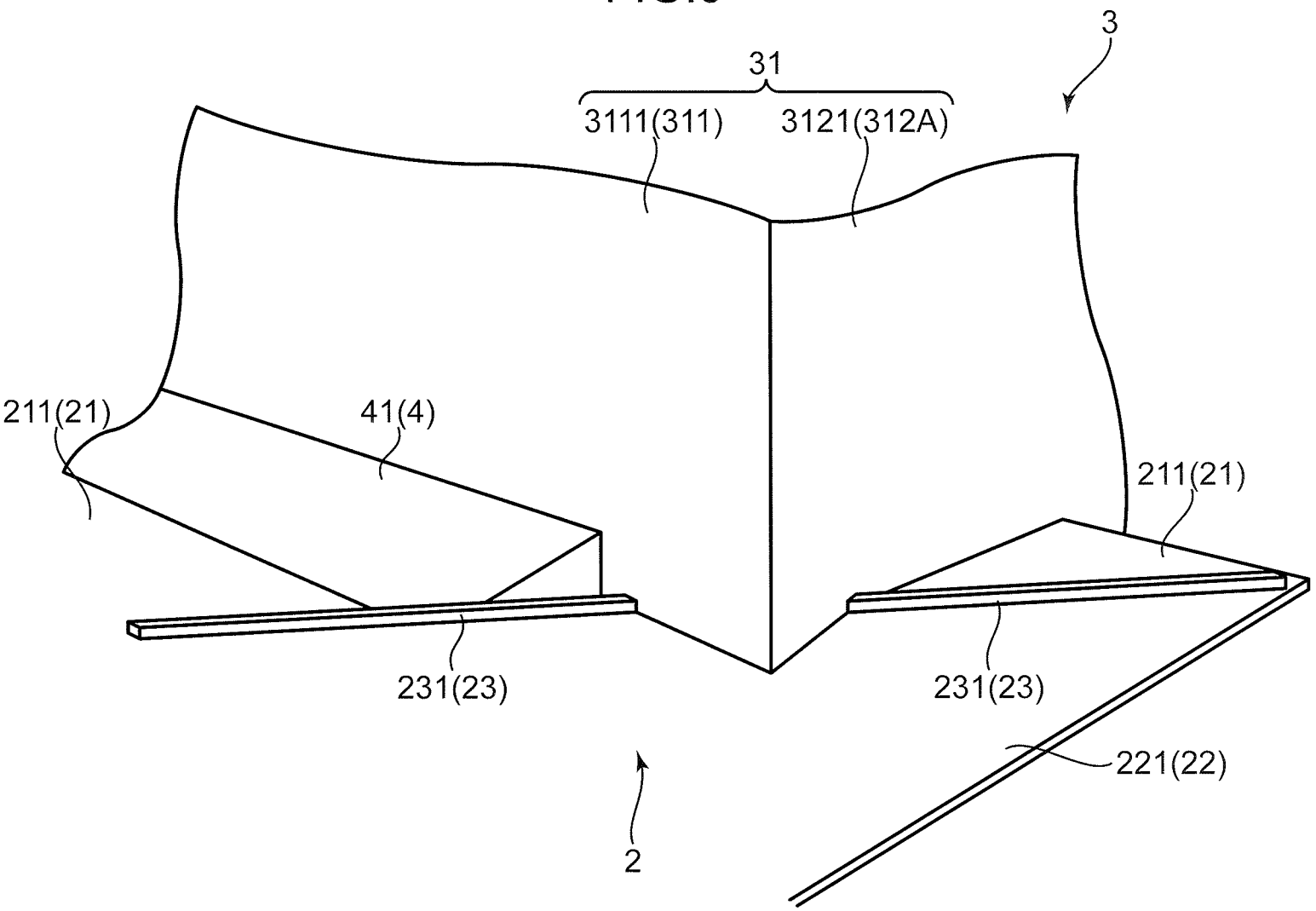
FIG. 9 is a diagram illustrating a construction procedure of a building, in which a hip base constituting a hip is installed and a water guide base constituting a water guide body is installed.

First, framework structures of the hipped roof 2 and the outer wall part 3 are installed. Specifically, the first roof board 211 of the first roof part 21 and the second roof board 221 of the second roof part 22 are installed on the hipped roof 2. Then, the first wall plate material 3111 of the first wall 311 constituting the erected part 31 and the second wall plate material 3121 constituting the pair of second walls 312A and 312B are installed in the outer wall part 3. The hip base 231 of the hip 23 is installed in such a state, as illustrated in FIG. 9. At this time, the hip base 231 is fixed at the boundary part between the first roof board 211 and the second roof board 221 while being in contact with the first wall plate material 3111 and the second wall plate material 3121.

Once the installation of the hip base 231 is completed, the water guide base 41 is installed covering the boundary part between the first roof board 211 and the first wall plate material 3111 from above as illustrated in FIG. 9. At this time, the water guide base 41 is installed and connected to not only the first roof board 211 and the first wall plate material 3111 but also the hip base 231.

Figure 10:
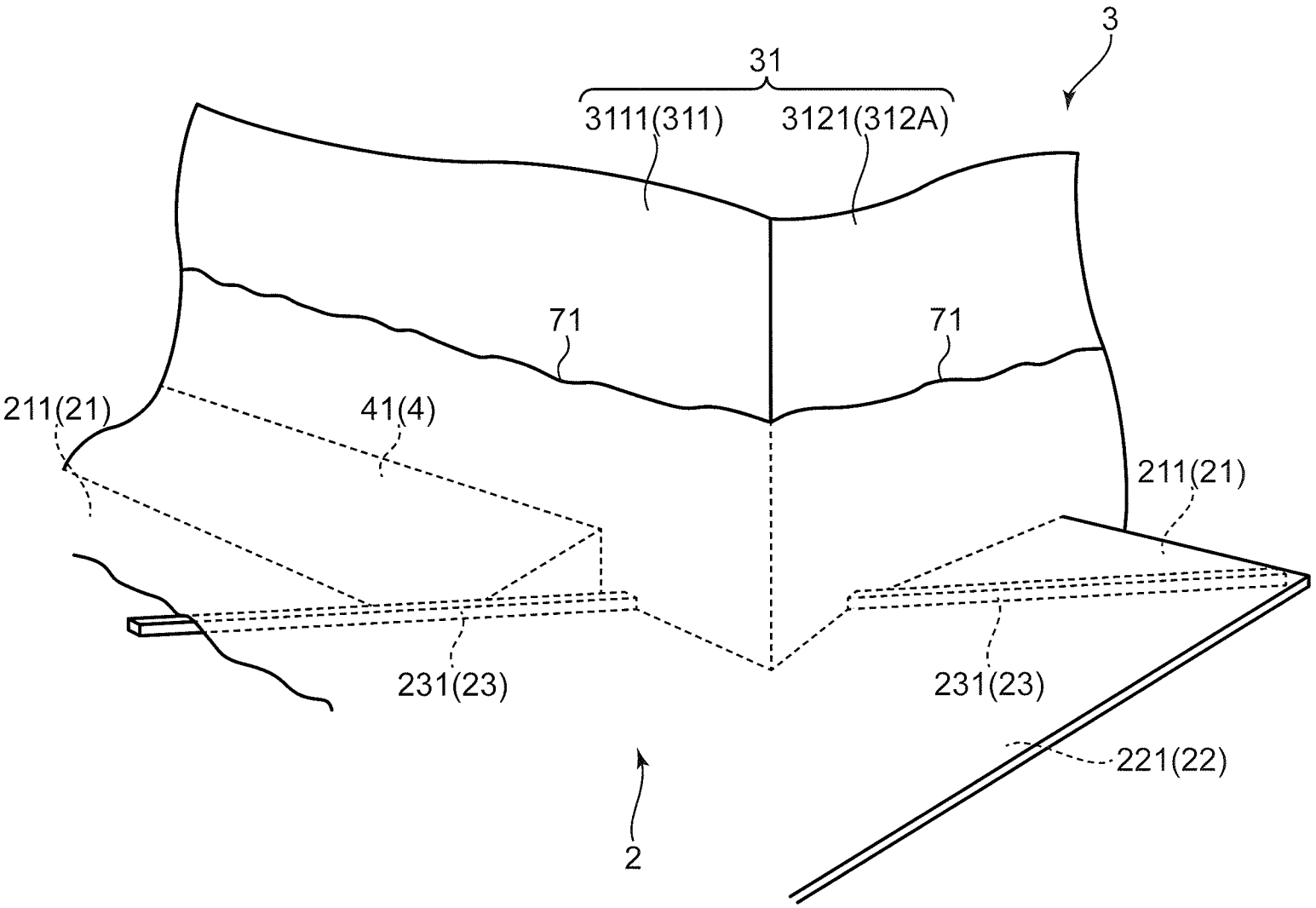
FIG. 10 is a diagram illustrating a construction procedure of a building, in which a roofing material is disposed.

Next, the roofing material 71 is disposed covering the upper surfaces of the first roof board 211 and the second roof board 221 as illustrated in FIG. 10. At this time, the roofing material 71 is disposed above the first roof board 211 and the second roof board 221 to not only cover the hip base 231 and the water guide base 41, but also erect along the first wall plate material 3111 and the second wall plate material 3121.

Figure 11:
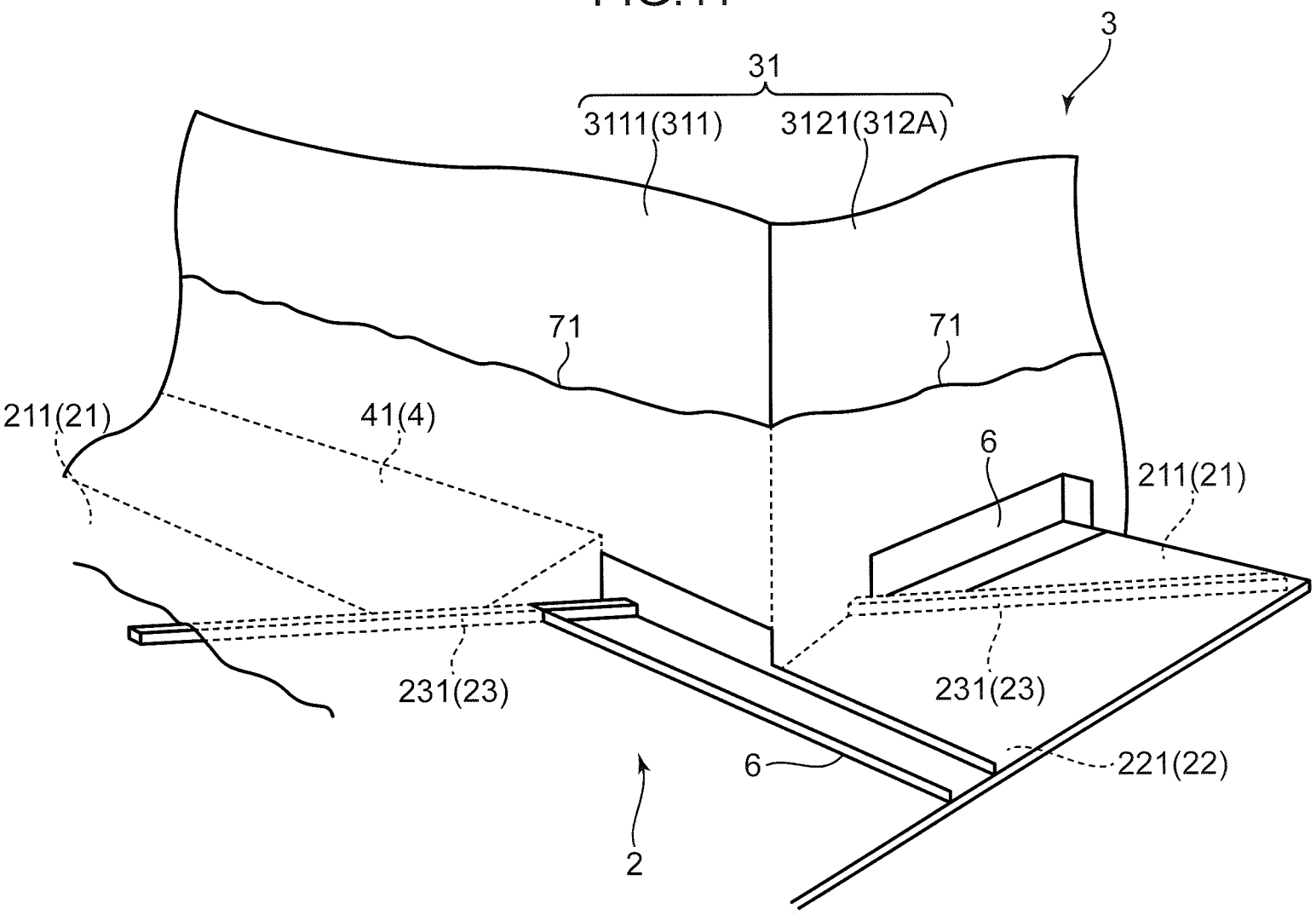
FIG. 11 is a diagram illustrating a construction procedure of a building, in which a drainage material is installed.

Subsequently, the drainage material 6 is installed at each of boundary parts from above the roofing material 71, the boundary parts including a boundary part between the second roof board 221 and the first wall plate material 3111, and a boundary part between the first roof board 211 and the second wall plate material 3121, as illustrated in FIG. 11. At this time, the drainage material 6 is connected to the hip base 231 to cover the hip base 231 from above the roofing material 71.

Figure 12:
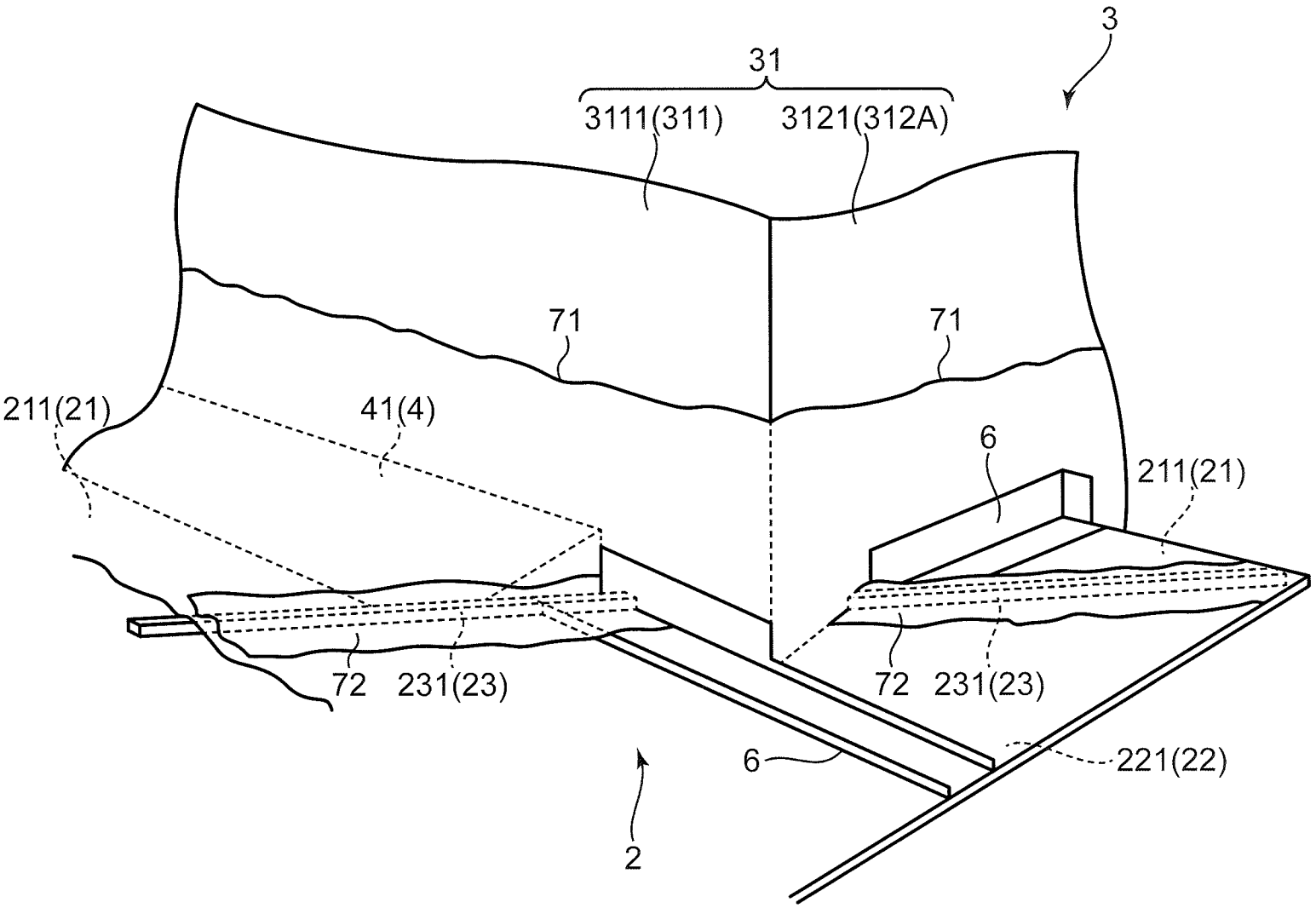
FIG. 12 is a diagram illustrating a construction procedure of a building, in which a waterproof material is disposed along a hip base.

Subsequently, the waterproof material 72 is disposed from above the roofing material 71 along the hip base 231 as illustrated in FIG. 12. At this time, the waterproof material 72 is disposed to erect along the water guide base 41 at the connection part of the water guide base 41 in the hip base 231.

Figure 13:
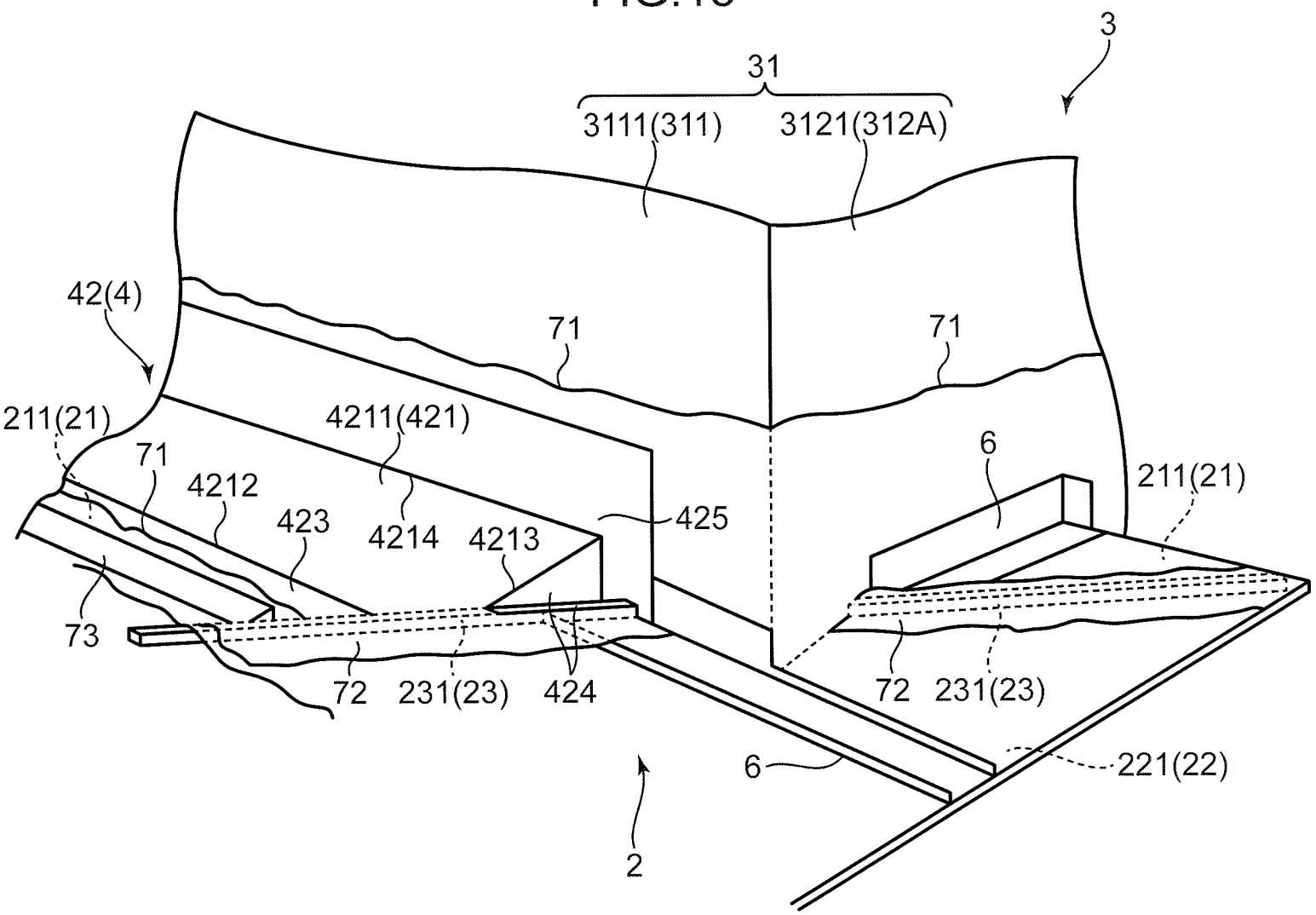
FIG. 13 is a diagram illustrating a construction procedure of a building, in which a water guide plate is installed on a water guide base.

Subsequently, the water guide plate 42 is installed above the water guide base 41 from above the roofing material 71 as illustrated in FIG. 13. The water guide plate 42 includes the water receiver 421 placed on the upper surface 41A of the covering plate 410 in the water guide base 41, and the caves guide part 422 extending along the second wall plate material 3121 of the second wall 312B. The water guide plate 42 further includes the roof covering part 423 covering the first roof board 211, the hip covering part 424 covering the hip base 231, and the wall covering part 425 covering the first wall plate material 3111.

Once the water guide plate 42 is installed above the water guide base 41, the roofing material 71 is disposed covering the roof covering part 423 of the water guide plate 42, and the base tile support material 73 is installed on the roofing material 71.

Figure 14:
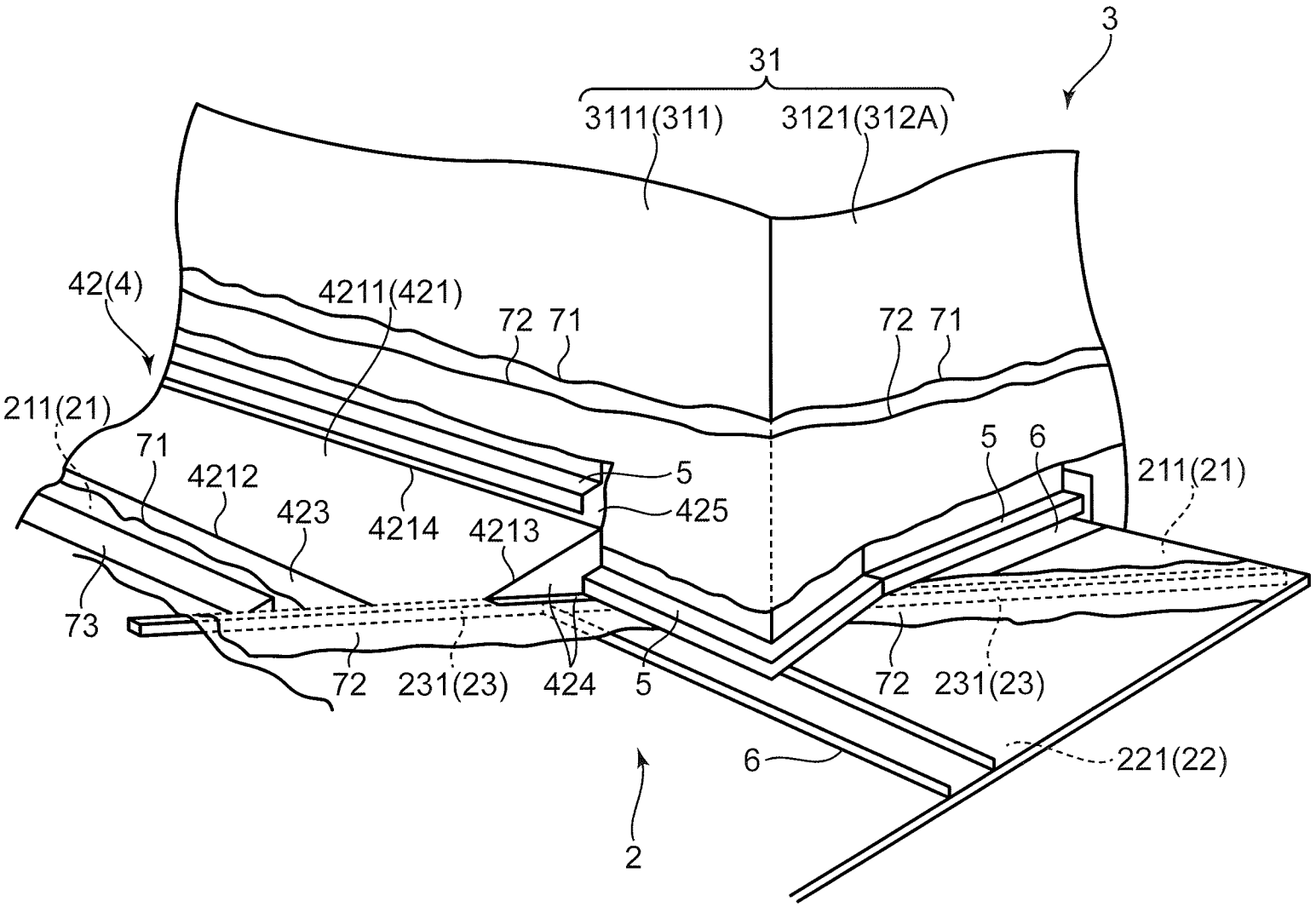
FIG. 14 is a diagram illustrating a construction procedure of a building, in which a wall draining material is installed and a waterproof material is disposed around the wall draining material.

Subsequently, the wall draining material 5 is fixed to the first wall plate material 3111 and the second wall plate material 3121 as illustrated in FIG. 14. Then, the waterproof material 72 is disposed from above the roofing material 71 to cover the first wall plate material 3111 and the second wall plate material 3121. At this time, the waterproof material 72 is disposed to cover an upper end part of the wall draining material 5.

Figure 15:
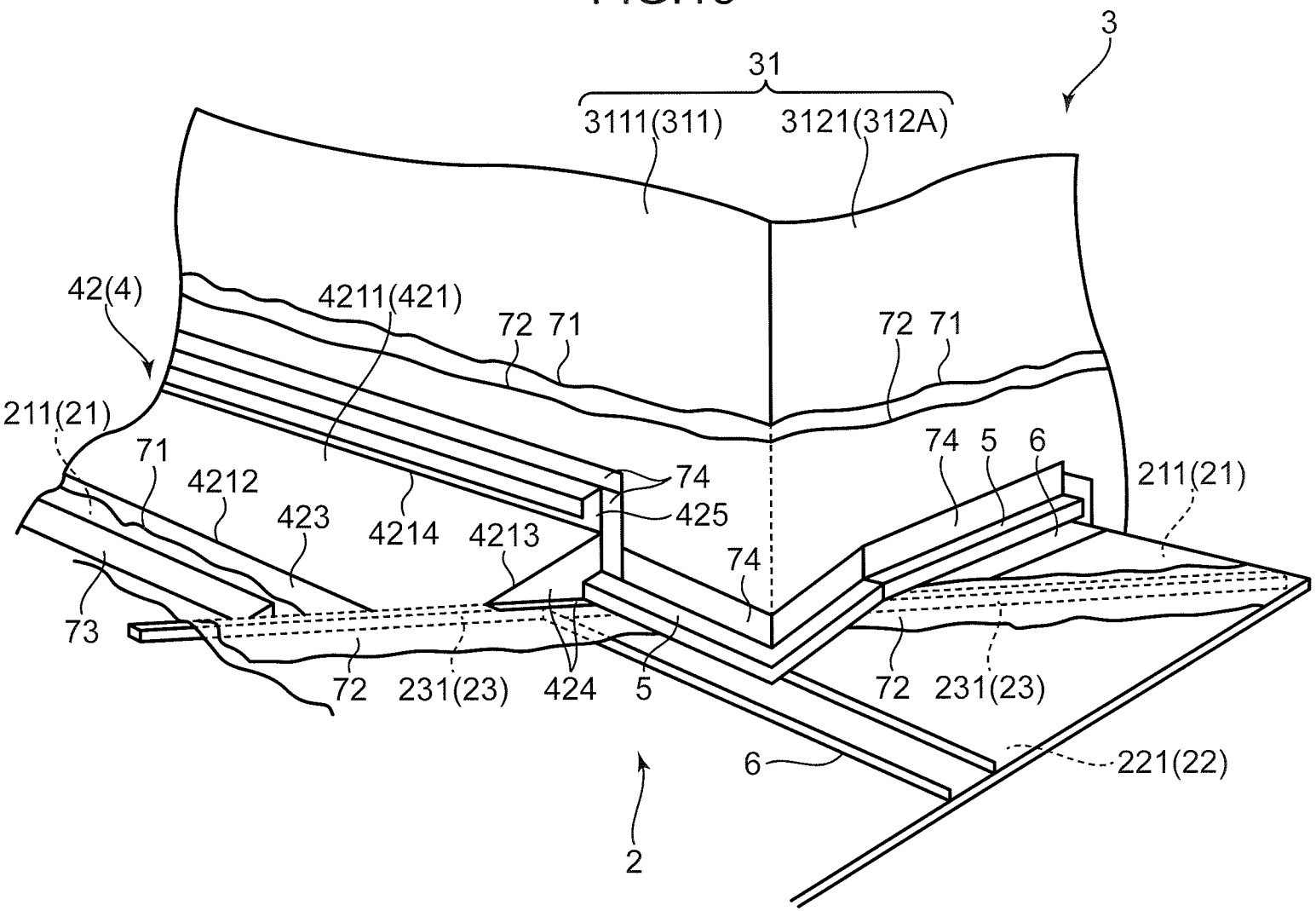
FIG. 15 is a diagram illustrating a construction procedure of a building, in which a wall draining material and a waterproof material are fixed with a waterproof tape.

Then, the waterproof material 72 includes a part covering the upper end part of the wall draining material 5, and the part is fixed to the wall draining material 5 by a waterproof tape 74 as illustrated in FIG. 15.

Figure 16:
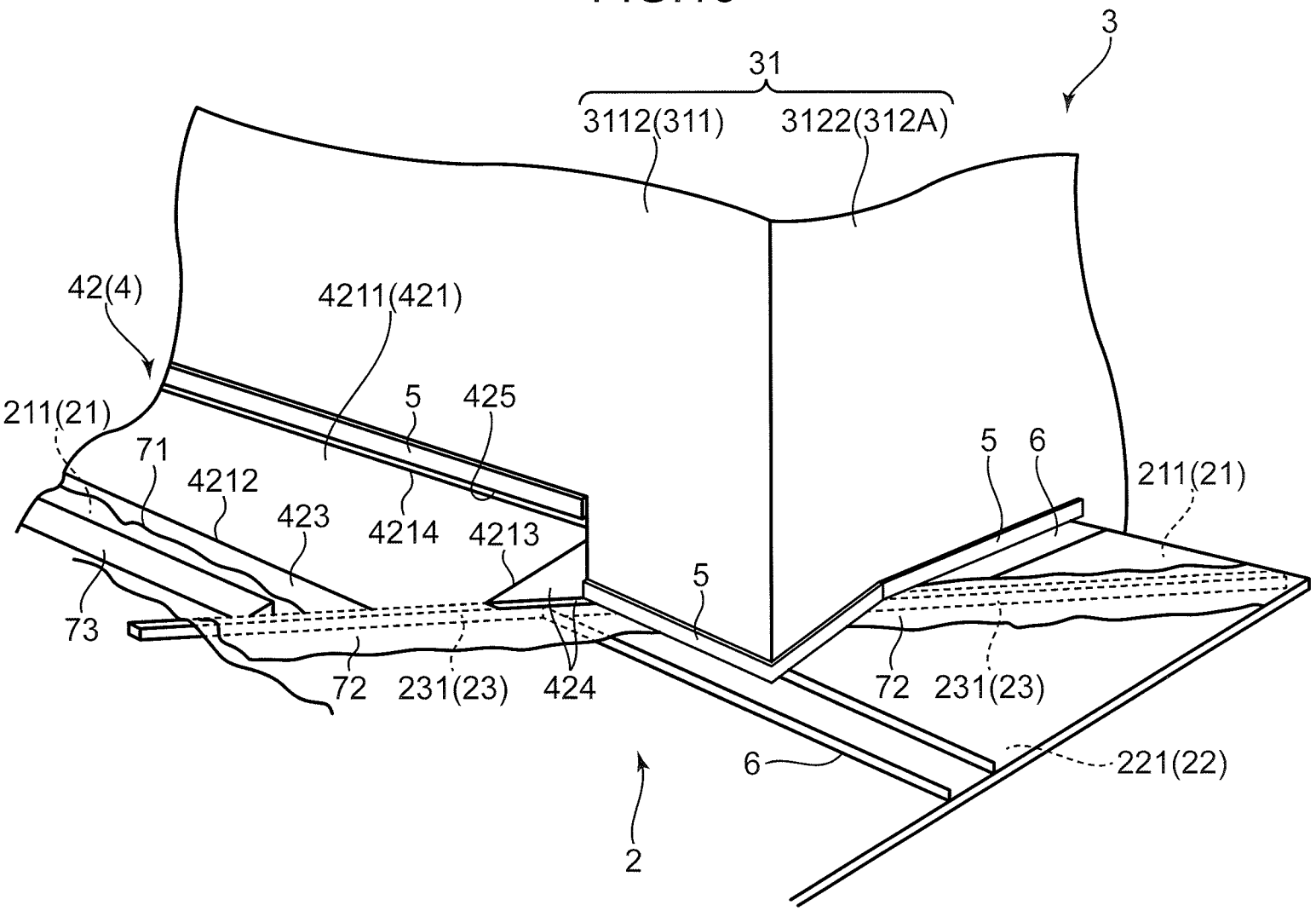
FIG. 16 is a diagram illustrating a construction procedure of a building, in which a siding material is attached to a wall plate material.

Subsequently, the first siding material 3112 is attached to cover the first wall plate material 3111, and the second siding material 3122 is attached to cover the second wall plate material 3121 as illustrated in FIG. 16.

Then, the first base tile 212 is installed for the first roof board 211 to be hooked on the first batten seam 213 above the roofing material 71, and the second base tile 222 is installed for the second roof board 221 to be hooked on the second batten seam 223 above the roofing material 71. The hip tile 232 is then fixed above the hip base 231 with the waterproof material 72 interposed therebetween.

The building 1 can be constructed based on construction according to the above construction procedure, the building 1 including the hipped roof 2 having the hip 23, the outer wall part 3 having the erected part 31 erected on the first roof part 21 of the hipped roof 2, and the water guide body 4 for guiding water flowing along the first roof part 21 to a lateral side of the erected part 31. As described above, the building 1 includes the water guide body 4 that can suppress accumulation of water flowing along the first roof part 21 in a region between the hip 23, the first roof part 21, and the side surface 311A of the first wall 311 in the erected part 31.

Modified Embodiment of Building

Although the building 1 according to the embodiment of the present invention has been described above, the present invention is not limited thereto, and modified embodiments below can be applied, for example.

Although the above embodiment described the configuration in which the water guide body 4 includes the water guide base 41 and the water guide plate 42 in which the roof connection edge 411 and the wall connection edge 412 of the covering plate 410 are positioned at an equal height in a sectional view taken along the plane orthogonal to the side surface 311A of the first wall 311 and the horizontal direction, and the water receiving roof side end edge 4212 and the water receiving wall side end edge 4214 of the water receiver 421 of the water guide plate 42 are positioned at an equal height in a sectional view taken along the plane orthogonal to the side surface 311A of the first wall 311 and the horizontal direction, the present invention is not limited thereto.

Figure 17:
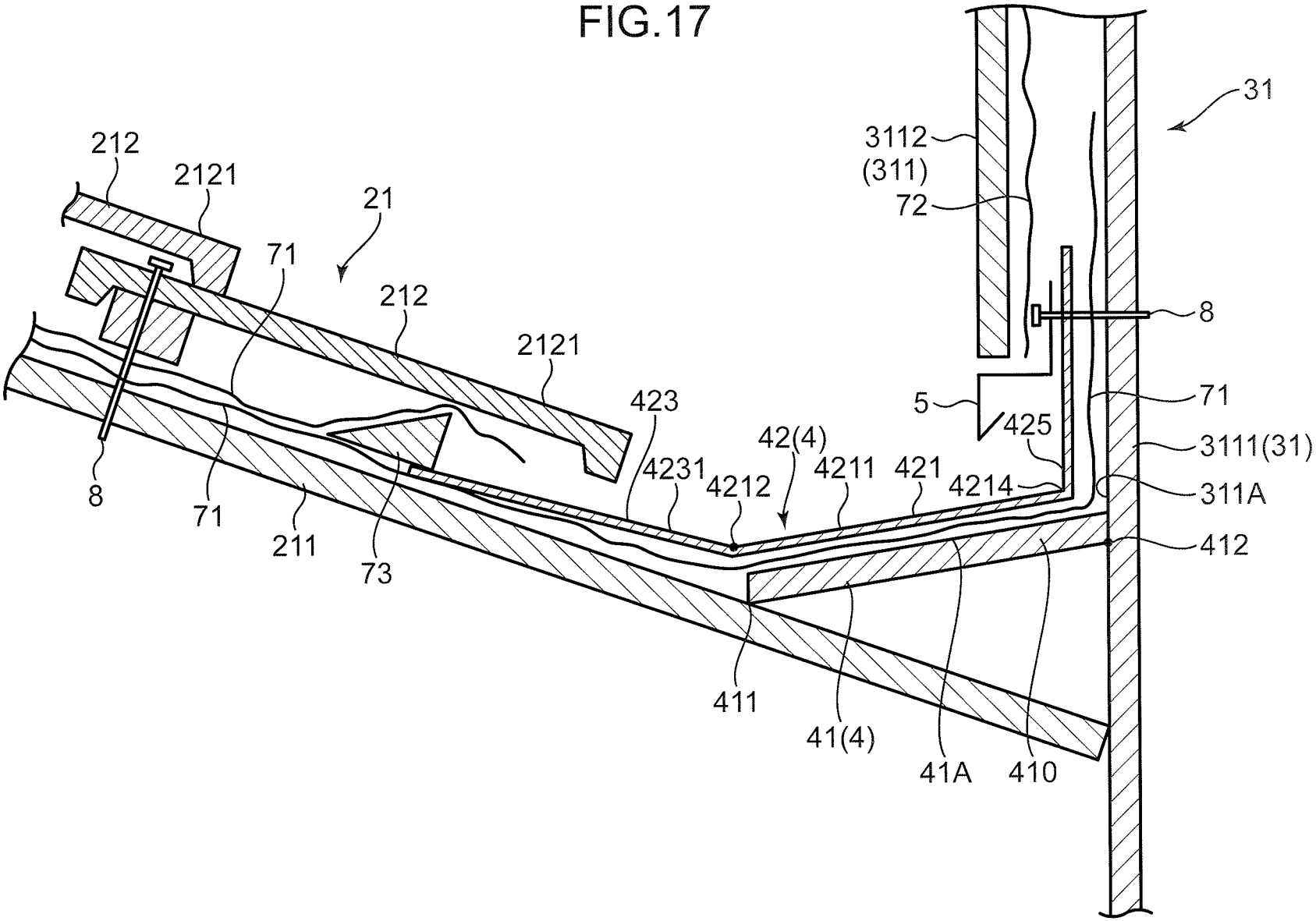
FIG. 17 is a diagram illustrating a modification of a water guide body provided in a building.

As illustrated in FIG. 17, the covering plate 410 of the water guide base 41 includes the wall connection edge 412 that may be positioned above the roof connection edge 411 in a sectional view taken along the plane orthogonal to the side surface 311A of the first wall 311 and the horizontal direction. In this case, the upper surface 41A of the covering plate 410 inclines upward toward the side surface 311A of the first wall 311. Then, the upper surface 41A of the covering plate 410 inclines downward with distance from the hip 23. The roof connection edge 411 extends from the hip 23 to the other end of the side surface 311A in the horizontal direction of the first wall 311 in a plan view in which the water guide base 41 is viewed from vertically above. The roof connection edge 411 also inclines downward with distance from the hip 23 in a front view in which the water guide base 41 is viewed from a direction orthogonal to the side surface 311A of the first wall 311.

When the covering plate 410 includes the upper surface 41A inclining upward toward the side surface 311A of the first wall 311, the water receiver 421 of the water guide plate 42 includes the water receiving wall side end edge 4214 positioned above the water receiving roof side end edge 4212 in a sectional view taken along the plane orthogonal to the side surface 311A of the first wall 311 and the horizontal direction. That is, the water receiving surface 4211 of the water receiver 421, which is a surface parallel to the upper surface 41A of the covering plate 410, inclines upward toward the side surface 311A of the first wall 311, as with the upper surface 41A of the covering plate 410. The water receiving surface 4211 of the water receiver 421 inclines downward with distance from the hip 23.

Then, the water receiving roof side end edge 4212 extends from the hip 23 to the other end of the side surface 311A in the horizontal direction of the first wall 311 in a plan view in which the water receiver 421 is viewed from vertically above, as with the roof connection edge 411 of the covering plate 410. The water receiving roof side end edge 4212 also inclines downward with distance from the hip 23 in a front view in which the water receiver 421 is viewed from a direction orthogonal to the side surface 311A of the first wall 311, as with the roof connection edge 411 of the covering plate 410.

The water receiver 421 configured as described above includes the water receiving surface 4211 inclining upward toward the side surface 311A of the first wall 311, so that water received by the water receiving surface 4211 by flowing along the first roof part 21 is returned to the water receiving roof side end edge 4212. The water receiving roof side end edge 4212 inclines downward with distance from the hip 23, and thus enabling the water returned to the water receiving roof side end edge 4212 to flow and separate from the hip 23 along the water receiving roof side end edge 4212. Thus, accumulation of water in a region between the hip 23, the first roof part 21, and the side surface 311A of the first wall 311 can be more reliably suppressed.

Although a configuration has been described in the above embodiment, in which the water receiver 421 of the water guide plate 42 includes the water receiving roof side end edge 4212 positioned on the roof connection edge 411 of the covering plate 410 and the water receiving surface 4211, each of which inclines downward with distance from the hip 23, the present invention is not limited to the configuration. The water receiver 421 may be configured such that at least one of the water receiving surface 4211 and the water receiving roof side end edge 4212 inclines downward with distance from the hip 23.

Although the hip 23 has been described as an example of the protrusion protruding upward from the roof upper surface 2121 of the first roof part 21 in the hipped roof 2 in the above embodiment, the present invention is not limited to the example. The protrusion is not limited to the hip 23 as long as the protrusion protrudes upward from roof upper surface 2121 of the first roof part 21.

The specific embodiment described above mainly includes the invention having the following configuration.

A building according to an aspect of the present invention includes: a hipped roof having a first roof part and a second roof part adjacent to each other in a horizontal direction, and a protrusion provided at a boundary part between the first roof part and the second roof part, the protrusion protruding upward from an upper surface of the first roof part; an erected part erected on the first roof part, the erected part having a side surface extending from a part of the protrusion toward a side opposite to the second roof part, the part being below an uppermost part of the first roof part, and the side surface facing the uppermost part of the first roof part; and a water guide body provided over the first roof part and the side surface of the erected part to guide water flowing along the first roof part toward a lateral side of the erected part. The water guide body is connected to the protrusion and has a shape for restricting accumulation of water in a region between the protrusion, the first roof part, and the erected part.

This building allows the water on the first roof part to flow along the first roof part toward the side surface of the erected part erected on the first roof part. The water guide body is provided over the first roof part and the side surface of the erected part, so that the water flowing along the first roof part can be guided to the lateral side of the erected part by the water guide body. The water guide body is also connected to the protrusion protruding upward from the upper surface of the first roof part, and has a shape for restricting accumulation of water in a region between the protrusion, the first roof part, and the erected part. The shape of the water guide body as described above enables suppressing accumulation of water flowing along the first roof part in the region between the protrusion, the first roof part, and the erected part.

The building described above may be configured such that the water guide body includes a water receiving surface that faces upward and receives water flowing along the first roof part, and the water receiving surface inclines downward with distance from the protrusion.

This aspect allows the water receiving surface of the water guide body to receive water flowing along the first roof part. The water receiving surface inclines downward with distance from the protrusion, and thus enabling the water received by the water receiving surface to flow and separate from the protrusion. Thus, this aspect enables accumulation of water in the region between the protrusion, the first roof part, and the erected part to be more reliably suppressed.

The building described above may be configured such that the water guide body includes a connection edge connected to the first roof part, the connection edge inclining downward with distance from the protrusion.

This aspect allows the water guide body to include the connection edge connected to the first roof part, the connection edge inclining downward with distance from the protrusion, and thus enables the water having reached the connection edge of the water guide body by flowing along the first roof part to flow along the connection edge and separate from the protrusion. Thus, this aspect enables accumulation of water in the region between the protrusion, the first roof part, and the erected part to be more reliably suppressed.

The building described above may be configured such that the protrusion includes a protrusion body provided at the boundary part between the first roof part and the second roof part, and a covering member attached to an upper surface of the protrusion body while covering the protrusion body and the first roof part from above, and the covering member includes a cutout provided at a position closer to the first roof part than an attachment position to the protrusion body so as to allow a space for receiving an end part of the water guide body to be formed, the end part being close to the protrusion.

This aspect enables the water guide body to be disposed adjacent to the protrusion while the first roof part is covered with the covering member in a region other than a region where the water guide body is provided. Then, the covering member including the cutout enables the covering member to be prevented from being divided by the water guide body, so that the covering member can be provided over the entire boundary part between the first roof part and the second roof part.

The building described above may be configured such that the water guide body includes a covering part provided to cover the protrusion body from above and vertically overlap the covering member.

This aspect allows the covering member of the protrusion and the covering part of the water guide body to vertically overlap each other, so that entry of water at a connection part between the protrusion and the water guide body can be prevented.

As described above, the present invention enables providing a building capable of suppressing accumulation of water flowing along the first roof part in the region between the protrusion, the first roof part, and the erected part.

The invention claimed is:

1. A building comprising:

a hipped roof including a first roof part declining downward from an uppermost part of the first roof part, a second roof part adjacent to the first roof part in a horizontal direction, and a protrusion provided at a boundary part between the first roof part and the second roof part, the protrusion protruding upward from an upper surface of the first roof part;

an erected part erected on the first roof part, the erected part having a side surface contacting a part of the protrusion and extending from the part toward a side opposite to the second roof part, the part being below the uppermost part of the first roof part, and the side surface facing the uppermost part of the first roof part and intersecting with a direction in which the first roof part declines downward; and a water guide body provided over the first roof part and the side surface of the erected part to guide water flowing along the first roof part toward a lateral side of the erected part, wherein the water guide body is connected to the protrusion and has a shape for restricting accumulation of water in a region between the protrusion, the first roof part, and the erected part.

2. The building according to claim 1, wherein the water guide body includes a water receiving surface that faces upward and receives water flowing along the first roof part, and the water receiving surface declines downward with distance from the protrusion.

3. The building according to claim 1, wherein the water guide body includes a connection edge connected to the first roof part, the connection edge declining downward with distance from the protrusion.

4. The building according to claim 1, wherein the protrusion includes a protrusion body provided at the boundary part between the first roof part and the second roof part, and a covering member attached to an upper surface of the protrusion body while covering the protrusion body and the first roof part from above, and the covering member includes a cutout provided at a position closer to the first roof part than an attachment position to the protrusion body so as to allow a space for receiving an end part of the water guide body to be formed, the end part being connected to the protrusion.

5. The building according to claim 4, wherein the water guide body includes a covering part provided to cover the protrusion body from above and vertically overlap the covering member.

* * * * *